US005200309A

United States Patent [19]

Merkel et al.

[11] Patent Number: 5,200,309

[45] Date of Patent: Apr. 6, 1993

[54] COLOR PHOTOGRAPHIC MATERIALS INCLUDING MAGENTA COUPLER, CARBONAMIDE COMPOUND AND ANILINE OR AMINE COMPOUND, AND METHODS

[75] Inventors: Paul B. Merkel, Rochester; Stephen P. Singer, Spencerport, both of N.Y.

[73] Assignee: Eastman Kodak Company, Rochester, N.Y.

[21] Appl. No.: 751,469

[22] Filed: Aug. 29, 1991

[51] Int. Cl.[5] ..... G03C 1/08; G03C 7/26; G03C 7/32

[52] U.S. Cl. ..... 430/546; 430/544; 430/551; 430/555

[58] Field of Search ..... 430/546, 544, 555, 551

[56] References Cited

U.S. PATENT DOCUMENTS

| | | | |
|---|---|---|---|
| 4,171,975 | 2/1979 | Kato et al. | 430/554 |
| 4,483,918 | 1/1984 | Sakai et al. | 430/372 |
| 4,540,657 | 9/1985 | Krishnamurthy | 430/544 |
| 4,555,479 | 7/1985 | Sakai et al. | 430/372 |
| 4,585,728 | 3/1986 | Furutachi et al. | 430/372 |
| 4,839,264 | 6/1989 | Kida | 430/551 |
| 4,857,449 | 4/1989 | Ogawa et al. | 430/546 |
| 4,894,318 | 1/1990 | Arakawa | 430/555 |
| 4,900,655 | 2/1990 | Nakazyo | 430/546 |
| 5,006,453 | 4/1991 | Takahashi | 430/546 |
| 5,011,764 | 4/1991 | Sakai | 430/546 |
| 5,019,493 | 5/1991 | Sato | 430/546 |
| 5,091,297 | 2/1992 | Fukunaga | 430/558 |

FOREIGN PATENT DOCUMENTS 3730557 4/1989 Fed. Rep. of Germany .

*Primary Examiner*—Charles L. Bowers, Jr.
*Assistant Examiner*—Geraldine Letscher
*Attorney, Agent, or Firm*—Lowe, Price, LeBlanc & Becker

[57] ABSTRACT

Color photographic materials comprise a support bearing a silver halide emulsion and a coupler composition. The coupler composition comprises a two-equivalent pyrazolone magenta dye-forming coupler, a ballasted carbonamide compound, and a ballasted aniline or amine compound. The carbonamide compound and the aniline or amine compound reduce continued coupling of the pyrazolone magenta dye-forming coupler during the bleach step in a color photographic process without altering the advantageous color image properties provided by the two-equivalent pyrazolone magenta dye-forming coupler

29 Claims, No Drawings

COLOR PHOTOGRAPHIC MATERIALS INCLUDING MAGENTA COUPLER, CARBONAMIDE COMPOUND AND ANILINE OR AMINE COMPOUND, AND METHODS

FIELD OF THE INVENTION

The present invention relates to color photographic materials and methods employing two-equivalent pyrazolone magenta dye-forming couplers. More particularly, the invention relates to such materials and methods wherein the two-equivalent pyrazolone magenta dye-forming coupler is used in combination with a ballasted carbonamide compound and a ballasted aniline or amine compound.

BACKGROUND OF THE INVENTION

Color photographic materials employing two-equivalent pyrazolone magenta dye-forming couplers are known in the art as demonstrated, for example, by the Sakai et al U.S. Pat. No. 4,483,918, the Furutachi et al U.S. Pat. No. 4,585,728 and German Off. DE 3,730,557. Two-equivalent pyrazolone magenta couplers are advantageous for use in color photographic materials owing to their low cost, high efficiency, good activity, adjustable hue and suitability for use in processes without formaldehyde.

It is also well known in the color photographic art that couplers are used in combination with solvents and other addenda which facilitate their incorporation in the photographic materials and/or improve one or more properties of the dyes formed from the couplers. For example, the Ogawa et al U.S. Pat. No. 4,857,449 discloses combinations of couplers and one or more high boiling organic solvents for use in color photographic materials. The Sakai et al and Furutachi et al patents cited above and the Sakai et al U.S. Pat. No. 4,555,479 disclose the use of aniline and amine addenda with two-equivalent pyrazolone magenta couplers to reduce stain that occurs in development processing. The Kato et al. U.S. Pat. No. 4,171,975 discloses combinations of aldehydebis type magenta couplers in combination with a carbonamide compound.

One disadvantage associated with the two-equivalent pyrazolone magenta dye-forming couplers is that they have low pKa values. The pKa value is $-\log Ka$, wherein Ka is the acid dissociation constant. Since these couplers tend to have low pKa values, they may be significantly ionized when films or papers coated with them are placed in solutions of low pH, i.e., a pH of 5–6, or less. Thus, when photographic materials containing these low pKa couplers are used in a process which does not employ a stop bath between the development and bleach steps, non-imagewise dye formation occurs owing to coupling with developer that is carried over into the bleach solution and oxidized therein. This phenomenon, which is referred to as continued coupling, produces undesirable increases in background density (Dmin). Continued coupling also leads to unacceptable density variability in processed films owing to variations in bleach pH as the bleach solutions become "seasoned" by continued use. Accordingly, photographic films and papers containing low pKa couplers such as the two-equivalent pyrazolone couplers often exhibit continued coupling because the couplers are more highly ionized at low pH and thus readily react with oxidized developer in the low pH bleach solutions. Thus, there is a need to provide color photographic materials which contain two-equivalent pyrazolone magenta dye-forming couplers and which exhibit a reduction in the continued coupling phenomenon.

SUMMARY OF THE INVENTION

Accordingly, it is an object of the present invention to provide improved color photographic materials and methods which employ two-equivalent pyrazolone magenta dye-forming couplers. It is an additional object of the invention to provide color photographic materials and methods which employ two-equivalent pyrazolone magenta dye-forming couplers and which exhibit a reduction in the continued coupling of the magenta dye-forming coupler during the bleach step of a color photographic process. It is a related object of the invention to provide such materials and methods exhibiting a reduction in the continued coupling phenomenon without disadvantageously effecting the improvements in color provided by the two-equivalent pyrazolone magenta dye-forming couplers.

These and additional objects and advantages are provided by the materials and methods of the present invention. The color photographic materials of the invention comprise a support bearing a silver halide emulsion and a coupler composition comprising a two-equivalent pyrazolone magenta dye-forming coupler, a carbonamide compound, and at least one compound selected from the group consisting of anilines and amines. The carbonamide compound and the aniline or amine compound in combination reduce the continued coupling phenomenon exhibited by the magenta dye-forming coupler, particularly as compared with the use of these compounds individually. However, the carbonamide compound and the aniline or amine compound do not disadvantageously alter the improved effects provided by the two-equivalent pyrazolone magenta dye-forming coupler. Thus, the color photographic materials according to the present invention provide images exhibiting gamma values similar to those obtained using conventional coupler solvents while substantially reducing undesirably high Dmin values and Dmin variability which are an indication of the continued coupling phenomenon. The ability of the combination of the carbonamide compound and the aniline or amine compound to reduce the continued coupling phenomenon without significantly changing the gamma values provided by the magenta coupler is surprising and unexpected, and advantageously provides improved color photographic materials and methods.

These and additional objects and advantages provided by the materials and methods of the present invention will be more fully apparent in view of the following detailed description.

DETAILED DESCRIPTION

The color photographic materials according to the present invention comprise a support bearing a silver halide emulsion and a coupler composition. The coupler composition comprises a two-equivalent pyrazolone magenta dye-forming coupler, a carbonamide compound and at least one compound selected from the group consisting of anilines and amines.

The coupler compositions employed in the present invention include a two-equivalent pyrazolone magenta dye-forming coupler. The two-equivalent pyrazolone magenta dye-forming coupler included in the coupler compositions of the present invention is of the formula:

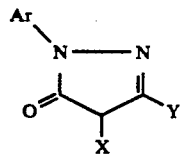

(I)

wherein:

Ar is selected from the group consisting of unsubstituted aryl groups, substituted aryl groups and substituted pyridyl groups, the substituents being selected from the group consisting of halogen atoms and cyano, alkylsulfonyl, arylsulfonyl, sulfamoyl, sulfonamido, carbamoyl, carbonamido, alkoxy, acyloxy, aryloxy, alkoxycarbonyl, aryloxycarbonyl, ureido, nitro, alkyl and trifluoromethyl groups;

Y is selected from the group consisting of anilino, acylamino and ureido groups and one of said groups substituted with one o more substituents selected from the group consisting of halogen atoms, and alkyl, aryl, alkoxy, aryloxy, carbonamido, carbamoyl, sulfonamido, sulfamoyl, alkylsulfoxyl, arylsulfoxyl, alkylsulfonyl , arylsulfonyl, alkoxycarbonyl, aryloxycarbonyl, acyl, acyloxy, ureido, imido, carbamate, heterocyclic, cyano, trifluoromethyl, alkylthio, nitro, carboxyl and hydroxyl groups, and groups which form a link to a polymeric chain, and wherein Y contains at least 6 carbon atoms; and X is a coupling-off group selected from the group consisting of halogen atoms, and alkoxy, aryloxy, alkylthio, arylthio, acyloxy, sulfonamido, sulfonyloxy, carbonamido, arylazo, nitrogen-containing heterocyclic and imido groups.

Coupling-off groups are well known to those skilled in the photographic art. Generally, such groups determine the equivalency of the coupler and modify the reactivity of the coupler. Coupling-off groups can also advantageously effect the layer in which the coupler is coated or other layers in the photographic material by performing, after release from the coupler, such functions as development inhibition, bleach acceleration, color correction, development acceleration and the like. Representative coupling-off groups include, as noted above, halogens (for example, chloro), alkoxy, aryloxy, alkylthio, arylthio, acyloxy, sulfonamido, carbonamido, arylazo, nitrogen-containing heterocyclic groups such as pyrazolyl and imidazolyl, and imido groups such as succinimido and hydantoinyl groups. Except for the halogens, these groups may be substituted if desired. Coupling-off groups are described in further detail in: U.S. Pat. Nos. 2,355,169; 3,227,551; 3,432,521; 3,476,563; 3,617,291; 3,880,661; 4,052,212 and 4,134,766, and in British Patent References Nos. 1,466,788; 1,531,927; 1,533,039; 2,006,755A and 2,017,704A, the disclosures of which are incorporated herein by reference.

Other magenta couplers, specifically methylene bis-pyrazolone magenta dye-forming couplers are excluded from the compositions of the present invention.

As is well known in the photographic art, a dye-forming coupler should be nondiffusible when incorporated in a photographic element. That is, the coupler should be of such a molecular size and configuration that it will exhibit substantially no diffusion from the layer in which it is coated. To achieve this result, the total number of carbon atoms contained in Y should be at least 6. Preferably, Y contains from 6 to about 30 carbon atoms.

In a preferred embodiment of the two-equivalent pyrazolone magenta dye-forming coupler of Formula (I), Ar is of the formula:

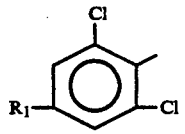

(II)

wherein $R_1$ is selected from the group consisting of halogen atoms and cyano, alkylsulfonyl, arylsulfonyl, sulfamoyl, sulfonamido, carbamoyl, carbonamido, ureido, alkoxycarbonyl, aryloxycarbonyl, acyloxy, alkoxy, aryloxy, nitro and trifluoromethyl groups.

If is further preferred that Y is of the formula:

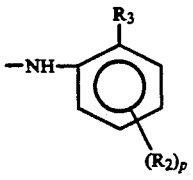

(III)

wherein p is from zero to 2 and each $R_2$ is in a meta or para position with respect to $R_3$;

each $R_2$ is individually selected from the group consisting of halogen atoms and alkyl, alkoxy, aryloxy, carbonamido, carbamoyl, sulfonamido, sulfamoyl, alkylsulfoxyl, arylsulfoxyl, alkylsulfonyl, arylsulfonyl, alkoxycarbonyl, aryloxycarbonyl, acyloxy, ureido, imido, carbamate, heterocyclic, cyano, nitro, acyl, trifluoromethyl, alkylthio and carboxyl groups, and;

$R_3$ is selected from the group consisting of hydrogen, halogen atoms and alkyl, alkoxy, aryloxy, alkylthio, carbonamido, carbamoyl, sulfonamido, sulfamoyl, alkylsulfonyl, arylsulfonyl, alkoxycarbonyl, acyloxy, acyl, cyano, nitro and trifluoromethyl groups. Preferably, $R_3$ is a chlorine atom or an alkoxy group.

In a further preferred embodiment of the magenta dye-forming coupler, the coupling-off group X is of the formula:

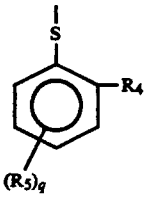

(IV)

in $R_4$ and $R_5$ are individually selected from the group where consisting of hydrogen, halogen atoms and alkyl, alkoxy, aryloxy, carbonamido, ureido, carbamate, sulfonamido, carbamoyl, sulfamoyl, acyloxy, alkoxycarbonyl, aryloxycarbonyl, amino and carboxyl groups; and wherein q is 0, 1 or 2 and R5 may be in the meta or para position with respect to the sulfur atom. Preferably, $R_4$ contains at least one carbon atom and $R_4$ and $R_5$ combined contain from about 5 to about 25 carbon atoms.

Examples of two-equivalent pyrazolone dye-forming magenta couplers suitable for use in the coupler compositions of the present invention include, but are not limited to, the following:
M1
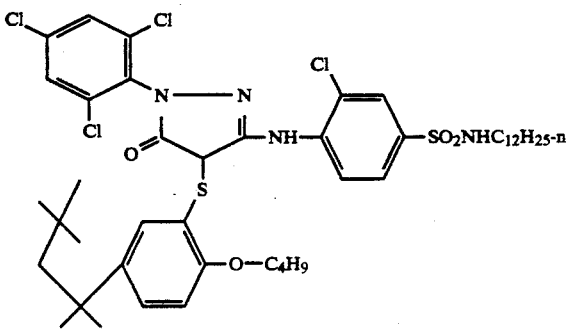
M2
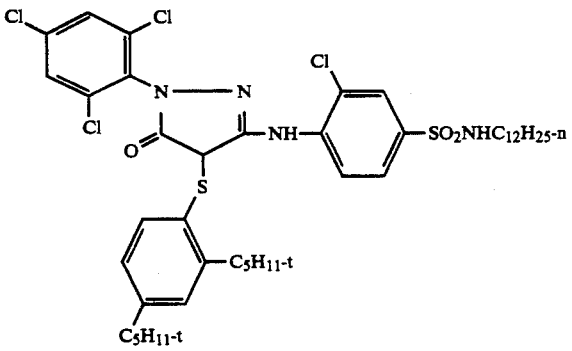
M3
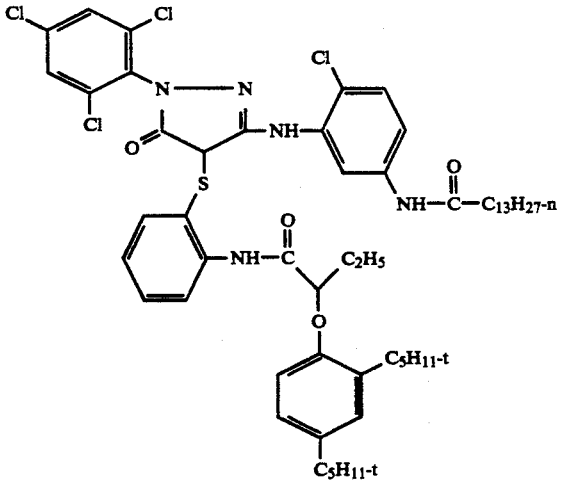

-continued
M4
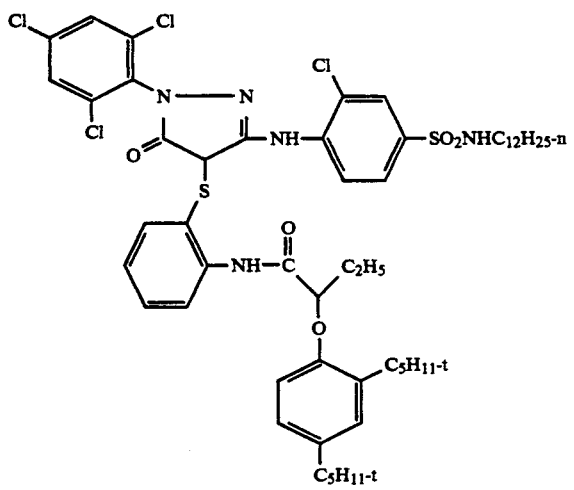
M5
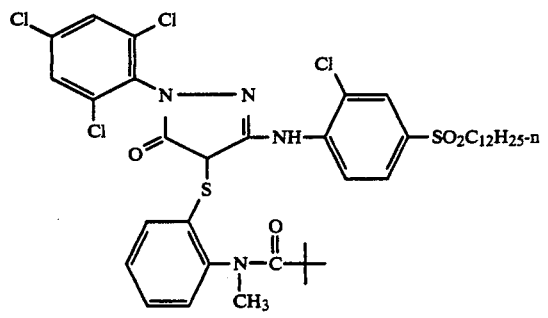
M6
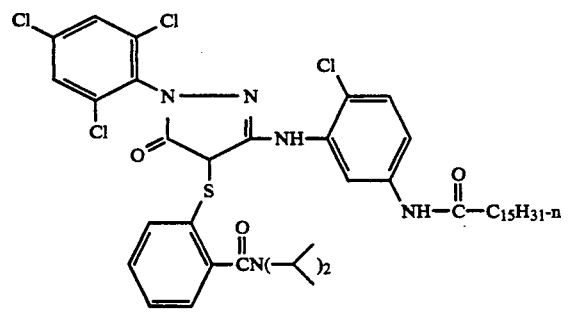
M7
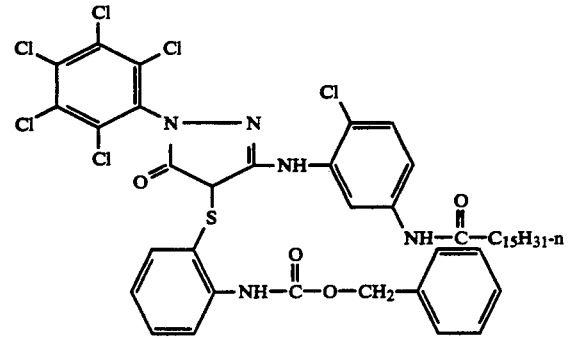

-continued
M8
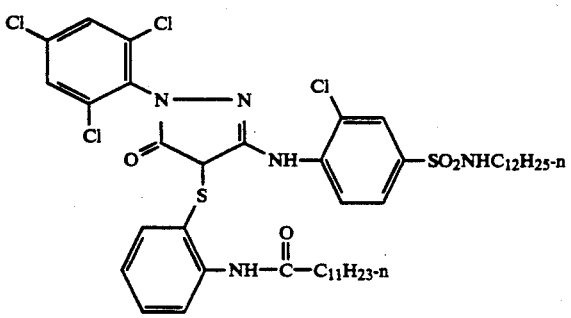
M9
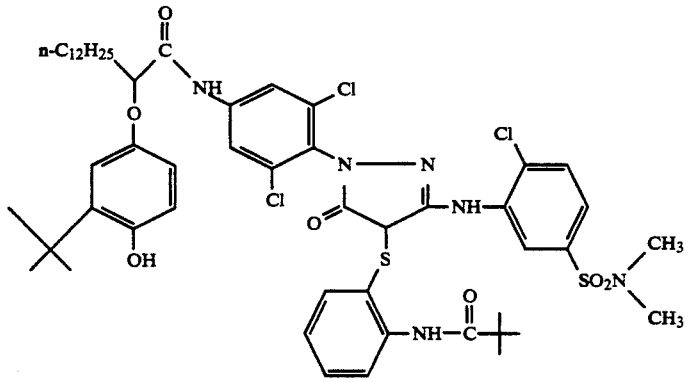
M10
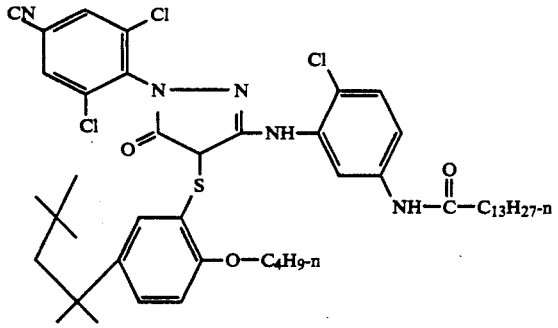
M11
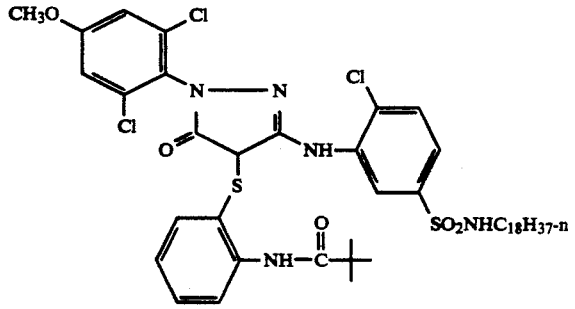

-continued
M12
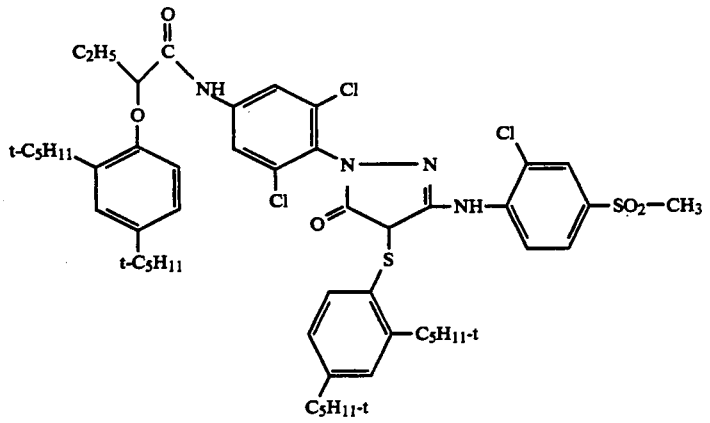
M13
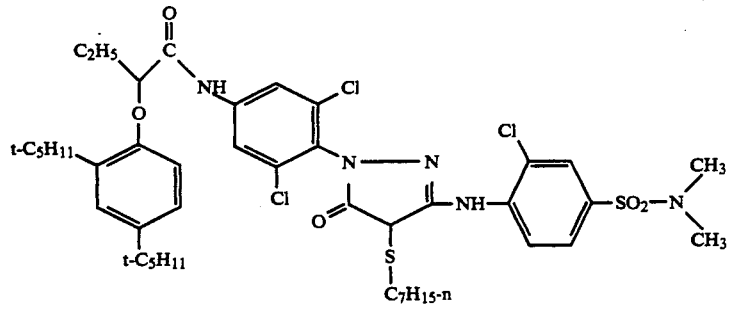
M14
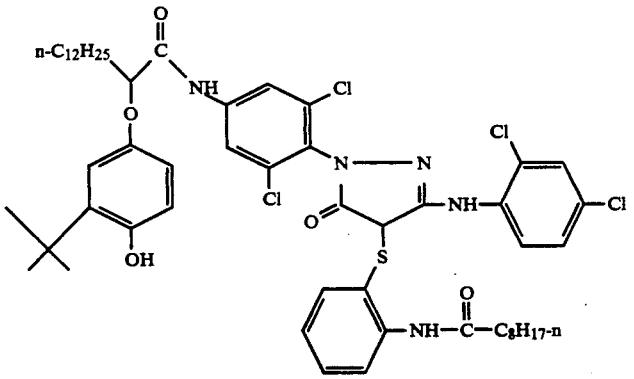
M15
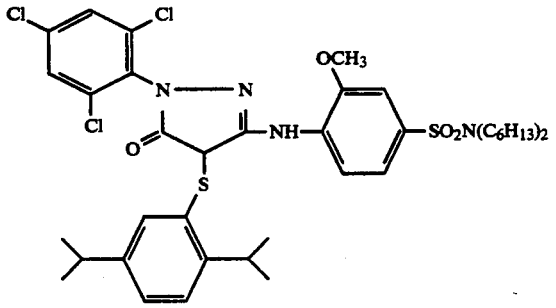

-continued
M16
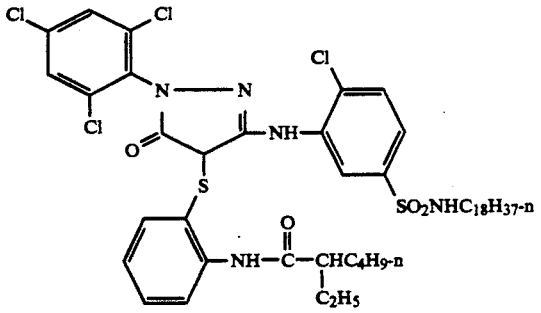
M17
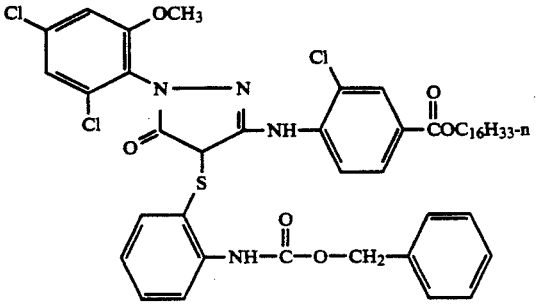
M18
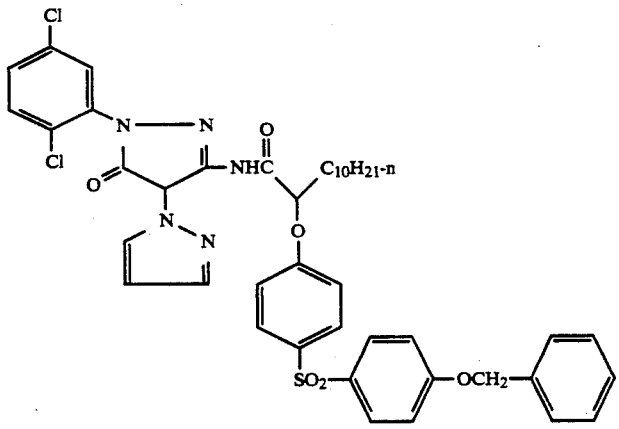
M19
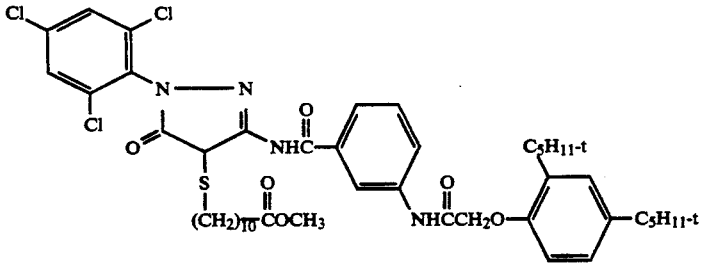
M20
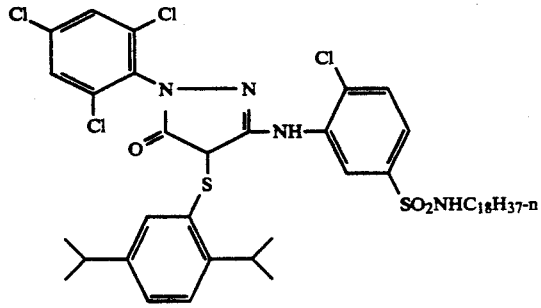

-continued

M21

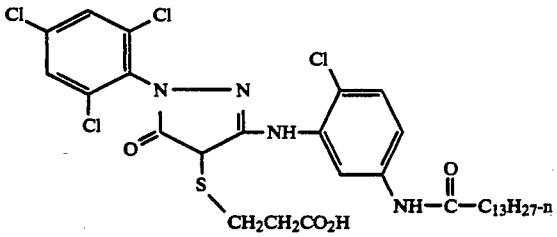

M22

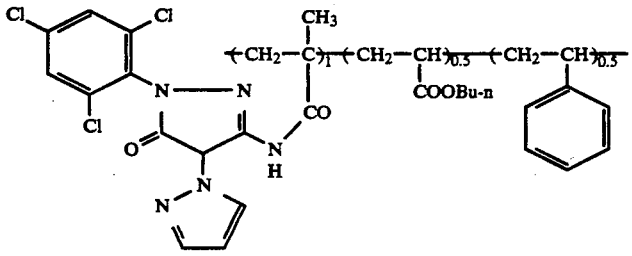

Particularly preferred two-equivalent magenta dye-forming couplers for use in the present invention include those that have pKa values of less than 10.0 when dispersed together with a coupler solvent.

The carbonamide compound included in the coupler compositions of the present invention is ballasted in order to minimize volatility, water solubility and diffusivity. The carbonamide compound acts as a solvent for the two-equivalent pyrazolone magenta dye-forming coupler and may be used in combination with one or more additional high-boiling cosolvents. It is preferred that the carbonamide compound included in the compositions of the present invention is of the formula:

$$R_6\overset{\overset{\displaystyle O}{\|}}{C}NR_7R_8 \qquad (V)$$

wherein, $R_6$, $R_7$ and $R_8$ are individually selected from the group consisting of (i) straight chain, branched and cyclic alkyl groups, straight chain and branched alkenyl groups and straight chain and branched alkylene groups, for example, forming bis compounds or rings; (ii) said alkyl groups, alkenyl groups and alkylene groups containing one or more substituents selected from the group consisting of alkoxy, aryloxy, aryl, alkoxycarbonyl, aryloxycarbonyl, and acyloxy groups and halogens; (iii) a phenyl group; and (iv) a phenyl group containing one or more substituents selected from the group consisting of alkyl, alkoxy, aryloxy, alkoxycarbonyl, aryloxycarbonyl and acyloxy groups and halogens; for example, chlorine and further wherein $R_6$, $R_7$ and $R_8$ combined contain at least 12 carbon atoms. Preferably, $R_6$, $R_7$ and $R_8$ combined contain from about 15 to about 30 carbon atoms in order to minimize volatility, water solubility and diffusivity.

In further preferred embodiments, at least one of $R_6$, $R_7$ and $R_8$ is an alkyl group, and/or $R_6$ and $R_7$ or $R_7$ and $R_8$ form a ring, for example, a five-membered pyrrolidinone ring or a six-membered nitrogen containing ring.

Examples of the carbonamide compound included in the coupler compositions of the invention include, but are not limited to, the following:

C1

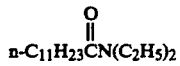

C2

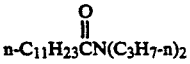

C3

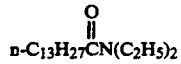

C4

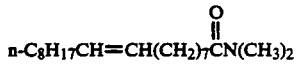

C5

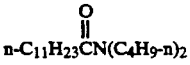

C6

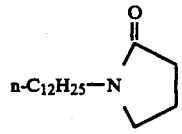

C7

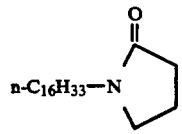

C8

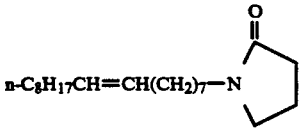

C9

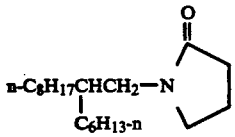

C10

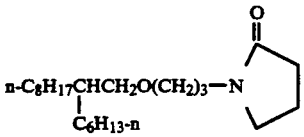

-continued

C11

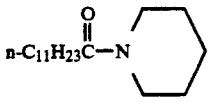

C12

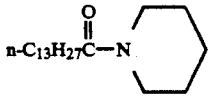

C13

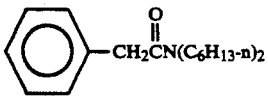

C14

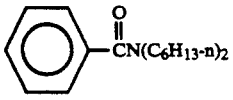

C15

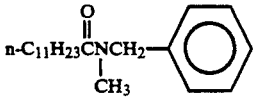

C16

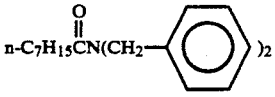

C17

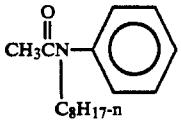

C18

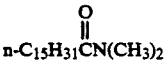

C19

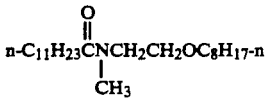

C20

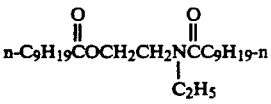

The coupler compositions which are employed in the photographic materials and methods of the present invention further include at least one compound selected from the group consisting of ballasted anilines and ballasted amines. The aniline or amine compound serves in combination with the carbonamide compound to reduce the continued coupling phenomenon of the two-equivalent pyrazolone magenta dye-forming coupler. Aniline compounds suitable for use in the coupler compositions of the present invention are of the following formula:

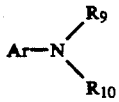

(VI)

wherein $R_9$ is selected from the group consisting of alkyl, aralkyl, cycloalkyl and alkenyl groups and said groups including one or more substituents selected from acyloxy, alkoxycarbonyl, aryloxycarbonyl, acylamino, carbamoyl, alkoxy and aryloxy groups; $R_{10}$ is selected from hydrogen and the $R_9$ moieties; and Ar is selected from the group consisting of phenyl and phenyl including one or more substituents selected from alkyl, aralkyl, alkenyl, cycloalkyl, alkoxy, aryloxy, phenyl and acylamino groups; and wherein $R_9$, $R_{10}$ and Ar combined contain at least 12 carbon atoms. Preferably, $R_9$, $R_{10}$ and Ar combined contain from about 20 to about 40 carbon atoms. In one embodiment, $R_9$ and $R_{10}$ or $R_9$ and Ar may be joined to form a ring.

In preferred embodiments of the aniline compounds represented by formula (VI), $R_9$ and $R_{10}$ are straight chained or branched alkyl groups and/or Ar is an alkyl or alkoxy substituted phenyl group. In a particularly preferred embodiment, Ar is a phenyl group substituted with an alkoxy group which is in a position ortho to the N atom. Additionally, the alkoxy-substituted phenyl group may include one or more additional substituents such as straight chained or branched alkyl groups.

Specific examples of aniline compounds suitable for use in the present invention include, but are not limited to, the following:

A1

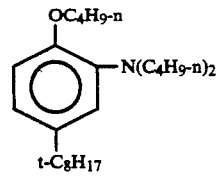

A2

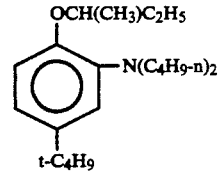

A3

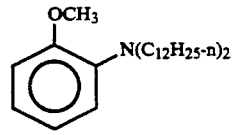

A4

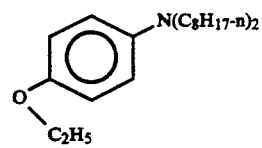

A5

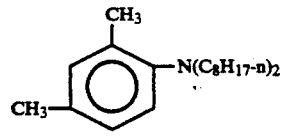

A6

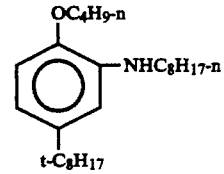

-continued

A7

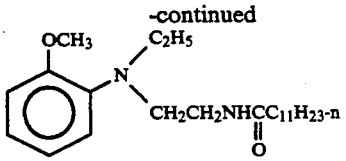

A8

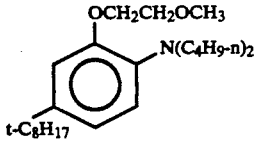

A9

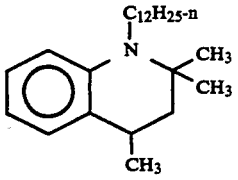

A10

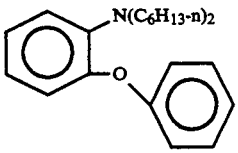

Amine compounds which are suitable for use in the coupler compositions of the present invention are preferably of the following formula:

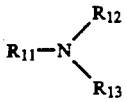

(VII)

wherein $R_{11}$ is selected from the group consisting of alkyl, cycloalkyl and alkenyl groups and said groups including one or more substituents selected from halogens and alkyl, aralkyl, acyloxy, alkoxycarbonyl, aryloxycarbonyl, acylamino, carbamoyl, alkoxy, aryloxy, hydroxy, alkylsulfonyl, arylsulfonyl, alkylsulfoxyl, arylsulfoxyl, phosphonyl and heterocyclic groups; and $R_{12}$ and $R_{13}$ are individually selected from hydrogen and the $R_{11}$ moieties; and wherein $R_{11}$, $R_{12}$ and $R_{13}$ combined contain at least 12 carbon atoms. Preferably, $R_{11}$, $R_{12}$ and $R_{13}$ combined contained from about 15 to about 40 carbon atoms in order to minimize the volatility, water solubility and diffusivity of the amine compound. In specific embodiments, $R_{11}$ and $R_{12}$ or $R_{12}$ and $R_{13}$ may be joined to form a ring. Additionally, $R_{12}$, $R_{13}$ and N may be joined together with an additional nitrogen atom or an oxygen atom to form a heterocyclic ring such as an imidazole ring or a morpholino ring.

Specific examples of amine compounds suitable for use in the present invention include, but are not limited to, the following:

A11

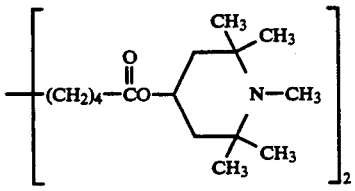

-continued

A12

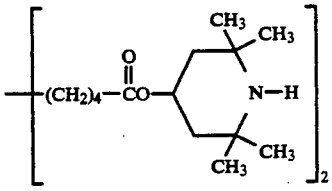

A13

$N(C_8H_{17}\text{-n})_3$

A14

$NH(C_8H_{17}\text{-n})_2$

A15

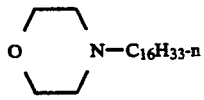

A16

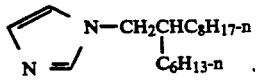

A17

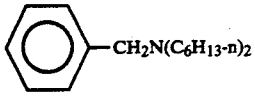

A18

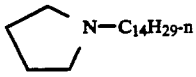

A19

$n\text{-}C_{12}H_{25}N(CH_2CH_2OCH_2CH_3)_2$

A20

$n\text{-}C_{11}H_{23}\text{—}\overset{O}{\overset{\|}{C}}\text{—}NH\text{—}CH_2CH_2\text{—}N(C_6H_{13}\text{-n})_2$ The coupler compositions according to the present invention include at least one compound selected from the anilines and amines as described above. However, it is equally within the scope of the present invention that the coupler compositions include at least one aniline compound and at least one amine compound together with the carbonamide compound and the two-equivalent pyrazolone magenta dye-forming coupler.

The coupler compositions which are employed in the present invention include the carbonamide compound and the aniline or amine compound in amounts suitable for providing a reduction in the continued coupling phenomenon without disadvantageously affecting the color properties of the resulting image. Specifically, the carbonamide compound and the aniline or amine compound are included in an amount sufficient to reduce continued coupling of the pyrazolone magenta dye-forming coupler during the bleach step of a color photographic process. In a preferred embodiment, the pyrazolone magenta dye-forming coupler and the carbonamide compound are included in a weight ratio of from about 1:0.1 to about 1:10. Preferably, the pyrazolone magenta dye-forming coupler and the aniline or amine compound are employed in a weight ratio of from about 1:0.03 to about 1:3, and more preferably from about 1:0.05 to about 1:1.

As noted above, the carbonamide compound acts as a solvent for the magenta dye-forming coupler. Additionally, one or more additional high-boiling organic compounds may also be employed as a cosolvent. Additional high-boiling coupler solvents that may be used in combination with the carbonamide compound include aryl phosphates, for example, tricresyl phosphate; alkyl phosphates, for example, trioctyl phosphate; mixed aryl alkyl phosphates; alkyl, aryl or mixed aryl alkyl phosphonates; phosphine oxides, for example, trioctyl phosphine oxide; aromatic esters, for example, dibutyl phthalate; aliphatic esters, for example, dibutyl sebecate; alcohols, for example, 2-hexyl-1-decanol; phenols, for example, p-dodecylphenol; sulfonamides; and hydrocarbons, for example, dodecylbenzene.

The coupler compositions of this invention may also include conventional additives, including light stabilizers, such as phenols or chromanols, and alkoxy benzene derivatives.

The photographic coupler compositions according to the present invention are employed in color photographic materials in a manner well known in the photographic art. For example, a supporting substrate may be coated with a silver halide emulsion and a coupler composition of the present invention comprising a two-equivalent magenta dye-forming pyrazolone coupler, a carbonamide compound and an aniline or amine compound, with the carbonamide compound and the aniline or amine compound present in sufficient amounts to reduce the continued coupling of the two-equivalent pyrazolone coupler during bleaching. The photographic materials may then be imagewise exposed in a manner well known in the color photographic art, followed by development in a solution containing a primary aromatic amine developing agent. As further well known in the art, the primary aromatic amine developing agent is oxidized in an imagewise manner by reacting with exposed silver halide emulsion grains, and the oxidized developing agent reacts with the coupler to form dye.

In employing the materials and methods of the present invention, the coated photographic material containing the magenta dye-forming coupler can be removed from the developer solution and placed directly in a bleaching solution without an intervening stop bath or wash step. The purpose of the bleaching solution is to reoxidize developed silver for subsequent fixation. However, the bleaching solution also oxidizes developing agent which is carried over in the absence of an intervening stop bath or wash. In conventional materials, the oxidized developer may react with coupler to produce non-imagewise dye (Dmin), i.e., the continued coupling phenomenon. The materials of this invention minimize the continued coupling.

The photographic materials of the present invention may be simple elements or multilayer, multicolor elements. Multicolor elements contain dye image-forming units sensitive to each of the three primary regions of the spectrum. Each unit can be comprised of a single emulsion layer or of multiple emulsion layers sensitive to a given region of the spectrum. The layers of the element, including the layers of the image-forming units, can be arranged in various orders as known in the art.

A typical multicolor photographic element comprises a support bearing a cyan dye image-forming unit comprising at least one red-sensitive silver halide emulsion layer having associated therewith at least one cyan dye-forming coupler, a magenta image-forming unit comprising at least one green-sensitive silver halide emulsion layer having associated therewith at least one magenta dye-forming coupler and a yellow dye image-forming unit comprising at least one blue-sensitive silver halide emulsion layer having associated therewith at least one yellow dye-forming coupler. The element may contain additional layers, such as filter layers, interlayers, overcoat layers, subbing layers, and the like. The element typically will have a total thickness (excluding the support) of from 5 to 30 microns. The support may be transparent or reflective.

Suitable materials for use in the elements of this invention are disclosed in *Research Disclosure,* December 1978, Item 17643; January 1983, Item 22534; and December 1989, Item No. 308119 published by Kenneth Mason Publications, Ltd., Dudley Annex, 12a North Street, Emsworth, Hampshire P010 7DQ, ENGLAND, the disclosures of which are incorporated herein by reference. This publication will be identified hereafter by the term "Research Disclosure." The elements of the invention can comprise emulsions and addenda described in these publications and publications referenced in these publications.

The silver halide emulsions employed in the elements of this invention can be comprised of silver bromide, silver chloride, silver iodide, silver chlorobromide, silver chloroiodide, silver bromoiodide, silver chlorobromoidide or mixtures thereof. The emulsions can include silver halide grains of any conventional shape or size. Specifically, the emulsions can include coarse, medium or fine silver halide grains. Useful tabular grain emulsions are described in Research Disclosure, Item 22534, and in U.S. Pat. No. 4,748,106, incorporated by reference. High aspect ratio tabular grain emulsions are specifically contemplated, such as those disclosed by Wilgus et al U.S. Pat. No. 4,434,226, Daubendiek et al U.S. Pat. No. 4,424,310, Wey U.S. Pat. No. 4,399,215, Solberg et al U.S. Pat. No. 4,433,048, Mignot U.S. Pat. No. 4,386,145, Evans et al U.S. Pat. No. 4,504,570, Maskasky U.S. Pat. No. 4,400,463, Wey et al U.S. Pat. No. 4,414,306, Maskasky U.S. Pat. Nos. 4,435,501 and 4,4414,966 and Daubendiek et al U.S. Pat. Nos. 4,672,027 and 4,693,964, incorporated herein by reference. Also specifically contemplated are those silver bromoiodide grains with a higher molar proportion of iodide in the core of the grain than in the periphery of the grain, such as those described in British Reference No. 1,027,146; Japanese Reference No. 54/48,521; U.S. Pat. Nos. 4,379,837; 4,444,877; 4,665,012; 4,686,178; 4,565,778; 4,728,602; 4,668,614 and 4,636,461; and in European Reference No. 264,954, incorporated by reference. The silver halide emulsions can be either monodisperse or polydisperse as precipitated. The grain size distribution of the emulsions can be controlled by silver halide grain separation techniques or by blending silver halide emulsions of differing grain sizes.

Sensitizing compounds, such as compounds of copper, thallium, lead, bismuth, cadmium and Group VIII noble metals, can be present during precipitation of the silver halide emulsion.

The emulsions can be surface-sensitive emulsions, i.e., emulsions that form latent images primarily on the surfaces of the silver halide grains, or internal latent image-forming emulsions, i.e., emulsions that form latent images predominantly in the interior of the silver halide grains. The emulsions can be negative-working emulsions, such as surface-sensitive emulsions or unfogged internal latent image-forming emulsions, or direct-positive emulsions of the unfogged, internal latent image-forming type, which are positive-working when development is conducted with uniform light exposure or in the presence of a nucleating agent.

The silver halide emulsions can be surface sensitized, and noble metal (e.g., gold), middle chalcogen (e.g., sulfur, selenium, or tellurium) and reduction sensitizers, employed individually or in combination, are specifically contemplated. Typical chemical sensitizers are listed in *Research Disclosure,* Item 17643, cited above, Section III.

The silver halide emulsions can be spectrally sensitized with dyes from a variety of classes, including the polymethine dye class, which includes the cyanines, merocyanines, complex cyanines and merocyanines (i.e., tri-, tetra-, and polynuclear cyanines and merocyanines), oxonols, hemioxonols, styryls, merostyryls, and streptocyoanines. Illustrative spectral sensitizing dyes are disclosed in *Research Disclosure,* Item 17643, cited above, Section IV.

Suitable vehicles for the emulsion layers and other layers of elements of this invention are described in Research Disclosure Item 17643, Section IX and the publications cited therein.

In addition to the two-equivalent pyrazolone magenta couplers described herein, the elements of this invention can include additional couplers as described in Research Disclosure Section VII, paragraphs D, E, F and G and the publications cited therein. These additional couplers can be incorporated as described in Research Disclosure Section VII, paragraph C, and the publications cited therein. The couplers of this invention can be used with colored masking couplers as described in U.S. Pat. No. 4,883,746, image modifying couplers (including DIR's and timed or switched DIR's as disclosed in U.S. Pat. Nos. 3,148,062, 3,227,554, 3,773,201, 4,409,323 and 4,248,962, incorporated by reference) or with couplers that release bleach accelerators as described in European Patent Application No. 193,389.

The photographic elements of this invention can contain brighteners (Research Disclosure Section V), antifoggants and stabilizers (Research Disclosure Section VI), antistain agents and image dye stabilizers (Research Disclosure Section VII, paragraphs I and J), light absorbing and scattering materials (Research Disclosure Section VIII), hardeners (Research Disclosure X), coating aids (Research Disclosure Section XI), plasticizers and lubricants (Research Disclosure Section XII), antistatic agents (Research Disclosure Section XIII), matting agents (Research Disclosure Sections XII and XVI) and development modifiers (Research Disclosure Section XXI).

The photographic elements can be coated on a variety of supports as described in Research Disclosure Section XVII and the references described therein.

The photographic elements of the invention can be exposed to actinic radiation, typically in the visible region of the spectrum, to form a latent image as described in Research Disclosure Section XVIII, and then processed to form a visible dye image as described in Research Disclosure Section XIX. Processing to form a visible dye image includes the step of contacting the element with a color developing agent to reduce developable silver halide and oxidize the color developing agent. Oxidized color developing agent in turn reacts with the coupler to yield a dye.

Preferred color developing agents are p-phenylenediamines. Especially preferred are 4-amino-3-methyl-N,N-diethylaniline hydrochloride, 4-amino-3-methyl-N-ethyl-N-β-(methanesulfonamido)-ethylaniline sulfate hydrate, 4-amino-3-methyl-N-ethyl-N-β-hydroxyethylaniline sulfate, 4-amino-3-β-(methanesulfonamido)ethyl-N,N-diethylaniline hydrochloride and 4-amino-N-ethyl-N,N-diethylaniline hydrochloride and 4-amino-N-ethyl-N-(2-methoxyethyl)-m-toluidine di-p-toluenesulfonic acid.

With negative-working silver halide, the processing step described above provides a negative image. The described elements are preferably processed in the known C-41 color process as described in, for example, the *British Journal of Photography Annual,* 1988, pages 196–198. To provide a positive (or reversal) image, the color development step can be preceded by development with a non-chromogenic developing agent to develop exposed silver halide, but not form dye, and then uniformly fogging the element to render unexposed silver halide developable. Alternatively, a direct positive emulsion can be employed to obtain a positive image.

Development is followed by the conventional steps of bleaching, fixing, or bleach-fixing, to remove silver or silver halide, washing, and drying.

The color photographic materials and methods of the present invention are demonstrated by the following examples, in which references are to parts by weight unless otherwise specified. References to comparative coupler solvents S1 and S2 refer, respectively, to mixed tritolyl phosphates and to dibutyl phthalate.

EXAMPLE 1

Preferred two-equivalent magenta dye-forming couplers for the practice of this invention include those that have pKa values of less than 10.0 when dispersed together with a coupler solvent. Potentiometric titrations were used to measure pKa values for some of the preferred couplers of the invention as aqueous dispersions. In these two-phase mixtures, the term pKa denotes the aqueous buffer pH at which half of the coupler in the oil phase is ionized or ion paired. Table I lists dispersion pKa values measured with 0.50 M potassium counter ion.

TABLE I

| Coupler | Coupler Solvent | Coupler:Solvent Weight Ratio | pKa(0.5M K+) |
|---|---|---|---|
| M1 | S2 | 1:2 | 8.5 |
| M7 | S2 | 1:2 | 7.5 |
| M8 | S2 | 1:2 | 7.9 |
| M20 | S2 | 1:2 | 8.4 |
| M20 | C1 | 1:2 | 8.9 |
| M3 | S1 | 1:1 | 7.9 |
| M3 | C5 | 1:1 | 8.2 |
| M4 | S1 | 1:1 | 7.6 |
| M4 | C5 | 1:1 | 8.0 |

EXAMPLE 2

Dispersions of couplers Ml and M2 were prepared (a) in comparative coupler solvents S1 and S2, (b) in a carbonamide coupler solvent of this invention, C1, and (c) in a 0.8:0.2 mixture of S1 and aniline compound A1. The weight ratio of coupler:solvent or coupler:solvent and aniline was 1:1. Dispersions were prepared by dissolving the coupler in a 1:3 mixture of coupler solvent plus cyclohexanone used as an auxiliary solvent, and aniline, if present. The mixtures were then added to an aqueous solution of gelatin and ALKANOL XC surfactant. The two-phase mixtures were passed through a colloid mill to disperse the coupler-containing oil phase in the aqueous phase in the form of small particles. The dispersion was then chilled, noodled and washed to remove the auxiliary cyclohexanone solvent. The resulting dispersions contained approximately 2% by weight of coupler and 6% by weight of gelatin.

The dispersions were coated on a transparent support at a coupler laydown of 0.54 mmole/$m^2$ together with a silver bromoiodide emulsion at a silver laydown of 1.08 g/$m^2$ in the following format:

| Cellulose Acetate Butyrate Support<br>2.69 g/$m^2$ Gelatin + 1.75 weight % BVSME Hardener |
|---|
| 0.54 mmole/$m^2$ Coupler (e.g. 0.50 g/$m^2$ of M1) |
| Coupler Solvent @ equal weight of coupler (and A1 if present) |
| 3.77 g/$m^2$ Gelatin |
| 1.08 g/$m^2$ Silver as Silver Halide Emulsion |

The BVSME hardner is of the formula ($CH_2$ =CH $SO_2$ $CH_2$)$_2$O. Coatings were then exposed and subjected to variants of the KODAK FLEXICOLOR (C-41) process described below. The C-41 process is described in *British Journal of Photography Annual,* 1988, pp. 196–198, discussed above. A first set of films was subjected to the standard C-41 process with no stop bath between the development and bleach steps (process A). A second set of films was also processed without a stop bath but with the FLEXICOLOR bleach pH adjusted to 6.0 instead of the normal 5.25 (process B). This was intended to simulate behavior in a "seasoned" bleach with increased pH due to carry-over of base from the developer solution. A third set of films was processed with an acetic acid stop bath between the development and bleach steps to eliminate any continued coupling (process C).

PROCESSING CONDITIONS

| Step | Solution (all at 100 F.) | Time |
|---|---|---|
| 1 | C-41 KF12 Developer | 3'15" |
| 2 | A: Standard C-41 Bleach II; | 4' |
| | or B: Bleach II Adjusted to pH = 6.0; | 4' |
| | or C: Stop Bath, followed by | 1' |
| | Standard C-41 Beach II | 4' |
| 3 | Wash | 3' |
| 4 | C-41 Fix | 4' |
| 5 | Wash | 3' |

The differences in Dmin values resulting from process A and process C or process B and process C are measures of the continued coupling at bleach pH values of 5.25 and 6.0, respectively. These differences are listed in Table II. Photographic gamma values, which serve as a measure of coupler activity, were obtained from plots of status M green density versus exposure for the various film samples subjected to process A. These gamma values are also listed in Table II.

TABLE II

| Coupler* | Coupler Solvent* | Aniline* | Delta Dmin Process A–C | Delta Dmin Process B–C | Gamma |
|---|---|---|---|---|---|
| M1(1.0) | S1(1.0) | — | 0.04 | 0.19 | 2.10 |
| M1(1.0) | S2(1.0) | — | 0.10 | 0.33 | 2.41 |
| M1(1.0) | C1(1.0) | — | 0.01 | 0.03 | 1.84 |
| M1(1.0) | S1(0.8 | A1(0.2) | 0.03 | 0.09 | 1.34 |
| M2(1.0) | S1(1.0) | — | 0.05 | 0.17 | 1.92 |
| M2(1.0) | S2(1.0) | — | 0.09 | 0.25 | 2.04 |
| M2(1.0) | C1(1.0) | — | 0.00 | 0.03 | 2.29 |

TABLE II-continued

| Coupler* | Coupler Solvent* | Aniline* | Delta Dmin Process A–C | Delta Dmin Process B–C | Gamma |
|---|---|---|---|---|---|
| M2(1.0) | S1(0.8) | A1(0.2) | 0.00 | 0.06 | 1.83 |

*Weight ratios are in parentheses.

As shown by the delta Dmin values in Table II, both the carbonamide coupler solvent C1 and the aniline compound A1 are effective in reducing continued coupling in the absence of a stop bath. The reductions in Dmin without a stop bath are particularly large in the simulated seasoned (pH=6.0) bleach. The results set forth in Table II demonstrate that the carbonamide C1 is more effective than the aniline A1 in reducing delta Dmin values at the A1 level which was used. Additionally, desirable high gamma values were maintained with C1, whereas the gamma value was reduced somewhat with A1. While higher levels of aniline or amine compounds can further reduce delta Dmin values by reducing continued coupling, such levels tend to also further reduce gamma values. Additionally, higher ratios of aniline or amine compounds relative to the coupler solvent can sometimes lead to coupler and/or dye solubility problems. Moreover, while for couplers M1 and M2, the levels of continued coupling were reduced with the carbonamide compound C1, it is often desirable to reduce the continued coupling to a further extent. With some couplers, for example, those employed in the subsequent Example, neither the carbonamide compound nor the aniline or amine compound alone are sufficient to reduce continued coupling and the associated Dmin values to acceptable levels.

EXAMPLE 3

Dispersions of pyrazolone magenta dye-forming couplers M3 and M4 were prepared in combination with coupler solvents S1 and C5, with and without aniline compound A1 by procedures similar to those of Example 2. The coupler:coupler solvent weight ratio was 1:1 for the dispersions without A1, and the dispersions with A1 were prepared at a 1:0.8:0.2 coupler:coupler solvent:A1 weight ratio. A dispersion of M4, C5 and amine compound All at M4:C5:All weight ratios of 1.0:0.85:0.15 was similarly prepared. These dispersions were coated on transparent supports at a coupler laydown of 0.54 mmole/$m^2$ together with a silver bromoiodide emulsion at a silver laydown of 1.08 g/$m^2$ as in Example 2. Hardened coatings were exposed and processed using procedures described in Example 2. The differences in Dmin values obtained with process A (Bleach pH=5.25, no stop bath) versus process C (Bleach pH=5.25, with stop bath) and with process B (Bleach pH=6.0, no stop bath) versus process C are listed in Table III. Larger differences are indicative of higher undesirable continued coupling. Photographic gamma values obtained from plots of status M green density versus exposure are also listed in Table III.

TABLE III

| Coupler* | Coupler Solvent* | Aniline or Amine* | Delta Dmin Process A–C | Delta Dmin Process B–C | Gamma |
|---|---|---|---|---|---|
| M3(1.0) | S1(1.0) | none | 0.09 | 0.26 | 2.65 |
| M3(1.0) | S1(0.8) | A1(0.2) | 0.03 | 0.09 | 2.34 |
| M3(1.0) | C5(1.0) | none | 0.04 | 0.13 | 2.70 |
| M3(1.0) | C5(0.8) | A1(0.2) | 0.02 | 0.05 | 2.31 |

TABLE III-continued

| Coupler* | Coupler Solvent* | Aniline or Amine* | Delta Dmin Process A–C | Delta Dmin Process B–C | Gamma |
|---|---|---|---|---|---|
| M4(1.0) | S1(1.0) | none | 0.23 | 0.48 | 3.31 |
| M4(1.0) | S1(0.8) | A1(0.2) | 0.17 | 0.33 | 3.15 |
| M4(1.0) | C5(1.0) | none | 0.08 | 0.20 | 3.06 |
| M4(1.0) | C5(0.8) | A1(0.2) | 0.05 | 0.12 | 2.83 |
| M4(1.0) | C5(0.85) | A11(0.15) | 0.04 | 0.11 | 2.56 |

*Weight ratios are in parenthesis.

It is evident from the data in Table III that, while both carbonamide C5 and aniline A1 reduce delta Dmin values due to continued coupling, neither compound by itself lowers continued coupling to a sufficiently low level. However, the combination of C5 and A1 with either M3 or M4 reduced delta Dmin values substantially below those values obtained with either C5 or A1 separately. In process B, the use of C5 in combination with A1 reduces delta Dmin by five-fold for M:3 and by four-fold for M4, relative to the comparative films containing S1 alone. In addition, the use of M3 or M4 in combination with C5 and A1 produces only acceptably small reductions in gamma values. The combination of M4, C5 and amine A11 yields similar reductions in delta Dmin and a small acceptable decrease in gamma. That combinations of a carbonamide compound and aniline or amine addenda would be so effective is not obvious from the prior art. Furthermore, it is not evident from the prior art that the materials and methods of this invention would reduce continued coupling without substantially reducing coupler activity and gamma values.

The preceding examples are set forth to illustrate specific embodiments of the invention and are not intended to limit the scope of the materials and methods of the present invention. Additional embodiments and advantages within the scope of the claimed invention will be apparent to one of ordinary skill in the art.

What is claimed is:

1. A color photographic material, comprising a support bearing a silver halide emulsion and a coupler composition comprising (a) a two-equivalent pyrazolone magenta dye-forming coupler, (b) a carbonamide compound, and (c) at least one compound selected from the group consisting of an aniline compound and an amine compound.

2. A color photographic material as defined by claim 1, wherein the two-equivalent pyrazolone magenta dye-forming coupler is of the formula:

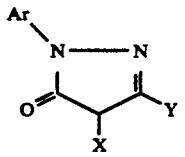

(I)

wherein:

Ar is selected from the group consisting of unsubstituted aryl groups, substituted aryl groups and substituted pyridyl groups, the substituents being selected from the group consisting of halogen atoms and cyano, alkylsulfonyl, arylsulfonyl, sulfamoyl, sulfonamido, carbamoyl, carbonamido, alkoxy, acyloxy, aryloxy, alkoxycarbonyl, aryloxycarbonyl, ureido, nitro, alkyl and trifluoromethyl groups;

Y is selected from the group consisting of anilino, acylamino and ureido groups and one of said groups substituted with one or more substituents selected from the group consisting of halogen atoms, and alkyl, aryl, alkoxy, aryloxy, carbonamido, carbamoyl, sulfonamido, sulfamoyl, alkylsulfoxyl, arylsulfoxyl, alkylsulfonyl, a rylsulfonyl, alkoxycarbonyl, aryloxycarbonyl, acyl, acyloxy, ureido, imido, carbamate, heterocyclic, cyano, trifluoromethyl, alkylthio, nitro, carboxyl and hydroxyl groups, and groups which form a link to a polymeric chain, and wherein Y contains at least 6 carbon atoms; and X is a coupling-off group selected from the group consisting of halogen atoms, and alkoxy, aryloxy, alkylthio, arylthio, acyloxy, sulfonamido, sulfonyloxy, carbonamido, arylazo, nitrogen-containing heterocyclic and imido groups.

3. A color photographic material as defined by claim 2, wherein Ar is of the formula:

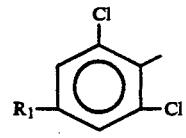

(II)

wherein $R_1$ is selected from the group consisting of halogen atoms and cyano, alkylsulfonyl, arylsulfonyl, sulfamoyl, sulfonamido, carbamoyl, carbonamido, ureido, alkoxycarbonyl, aryloxycarbonyl, acyloxy, alkoxy, aryloxy, nitro and trifluoromethyl groups.

4. A color photographic material as defined by claim 2, wherein Y is of the formula:

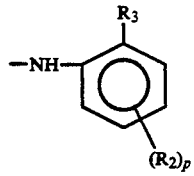

(III)

wherein p is from zero to 2 and each $R_2$ is in a meta or para position with respect to $R_3$;

each $R_2$ is individually selected from the group consisting of halogen atoms and alkyl, alkoxy, aryloxy, carbonamido, carbamoyl, sulfonamido, sulfamoyl, alkylsulfoxyl, arylsulfoxyl, alkylsulfonyl, arylsulfonyl, alkoxycarbonyl, aryloxycarbonyl, acyloxy, ureido, imido, carbamate, heterocyclic, cyano, nitro, acyl, trifluoromethyl, alkylthio and carboxyl groups, and;

$R_3$ is selected from the group consisting of hydrogen, halogen atoms and alkyl, alkoxy, aryloxy, alkylthio, carbonamido, carbamoyl, sulfonamido, sulfamoyl, alkylsulfonyl, arylsulfonyl, alkoxycarbonyl, acyloxy, acyl, cyano, nitro and trifluoromethyl groups.

5. A color photographic material as defined by claim 2, wherein X is of the formula:

(IV)

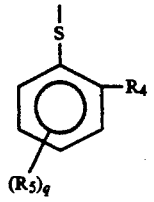

wherein $R_4$ and $R_5$ are individually selected from the group consisting of hydrogen, halogen atoms and alkyl, alkoxy, aryloxy, carbonamido, ureido, carbamate, sulfonamido, carbamoyl, sulfamoyl, acyloxy, alkoxycarbonyl, aryloxycarbonyl, amino and carboxyl groups; and wherein q is 0, 1 or 2 and $R_5$ may be in the meta or para position with respect to the sulfur atom.

6. A color photographic material as defined by claim 5, wherein $R_4$ contains at least one carbon atom, and further wherein the total number of carbon atoms in $R_4$ and $R_5$ is from about 5 to about 25.

7. A color photographic material as defined by claim 1, wherein the carbonamide compound is of the formula:

$$R_6C(=O)NR_7R_8 \quad \text{(V)}$$

wherein $R_6$, $R_7$ and $R_8$ are individually selected from the group consisting of (i) straight chain, branched and cyclic alkyl groups, straight chain and branched alkenyl groups and straight chain and branched alkylene groups, (ii) said alkyl groups, alkenyl groups and alkylene groups containing one or more substituents selected from the group consisting of alkoxy, aryloxy, aryl, alkoxycarbonyl, aryloxycarbonyl, and acyloxy groups and halogens; (iii) a phenyl group; and (iv) a phenyl group containing one or more substituents selected from the group consisting of alkyl, alkoxy, aryloxy, alkoxycarbonyl, aryloxycarbonyl and acyloxy groups and halogens; and further wherein $R_6$, $R_7$ and $R_8$ combined contain at least 12 carbon atoms.

8. A color photographic material as defined by claim 7, wherein $R_6$, $R_7$ and $R_8$ combined contain from about 15 to about 30 carbon atoms.

9. A color photographic material as defined by claim 7, wherein at least one of $R_6$, $R_7$ and $R_8$ is an alkyl group.

10. A color photographic material as defined by claim 9, wherein $R_6$, $R_7$ and $R_8$ are individually selected from the group consisting of unsubstituted alkyl, alkenyl and alkylene groups.

11. A color photographic material as defined by claim 7, wherein $R_6$, $R_7$ and $R_8$ are individually selected from the group consisting of cycloalkyl, aralkyl, phenyl and alkylphenyl groups.

12. A color photographic material as defined by claim 7, wherein $R_6$ and $R_7$ or $R_7$ and $R_8$ form a ring.

13. A color photographic material as defined by claim 12, wherein $R_6$ and $R_7$ or $R_7$ and $R_8$ form a five-membered pyrrolidinone ring.

14. A color photographic material as defined by claim 1, including the aniline compound and wherein the aniline compound is of the formula:

$$Ar-N(R_9)(R_{10}) \quad \text{(VI)}$$

wherein $R_9$ is selected from the group consisting of alkyl, aralkyl, cycloalkyl and alkenyl groups and said groups including one or more substituents selected from acyloxy, alkoxycarbonyl, aryloxycarbonyl, acylamino, carbamoyl, alkoxy and aryloxy groups; $R_{10}$ is selected from hydrogen and the $R_9$ moieties; and Ar is selected from the group consisting of phenyl and phenyl including one or more substituents selected from alkyl, aralkyl, alkenyl, cycloalkyl, alkoxy, aryloxy, phenyl and acylamino groups; and wherein $R_9$, $R_{10}$ and Ar combined contain at least 12 carbon atoms.

15. A color photographic material as defined by claim 14, wherein $R_9$ and $R_{10}$ are individually selected from branched and straight chain alkyl groups.

16. A color photographic material as defined by claim 14, wherein Ar is phenyl including at least one alkyl or alkoxy substituent.

17. A color photographic material as defined by claim 16, wherein Ar comprises phenyl with an alkoxy group substituent which is ortho to the N atom.

18. A color photographic material as defined by claim 14, wherein $R_9$, $R_{10}$ and Ar combined contain from about 20 to about 40 carbon atoms.

19. A color photographic material as defined by claim 1, including the amine compound and wherein the amine compound is of the formula:

$$R_{11}-N(R_{12})(R_{13}) \quad \text{(VII)}$$

wherein $R_{11}$ is selected from the group consisting of alkyl, cycloalkyl and alkenyl groups and said groups including one or more substituents selected from halogens and alkyl, aralkyl, acyloxy, alkoxycarbonyl, aryloxycarbonyl, acylamino, carbamoyl, alkoxy, aryloxy, hydroxy, alkysulfonyl, arylsulfonyl, alkysulfoxyl, arylsulfoxyl, phosphonyl and heterocyclic groups; and $R_{12}$ and $R_{13}$ are individually selected from hydrogen and the $R_{11}$ moieties; and wherein $R_{11}$, $R_{12}$ and $R_{13}$ combined contain at least 12 carbon atoms.

20. A color photographic material as defined by claim 19, wherein $R_{11}$ and $R_{12}$ or $R_{12}$ and $R_{13}$ form a ring.

21. A color photographic material as defined by claim 19, wherein at least one of $R_{11}$, $R_{12}$ and $R_{13}$ is an alkyl group.

22. A color photographic material as defined by claim 19, wherein $R_{11}$, $R_{12}$ and $R_{13}$ combined contain from about 15 to about 40 carbon atoms.

23. A color photographic material as defined by claim 1, wherein the carbonamide compound is included in the coupler composition in an amount sufficient to reduce continued coupling of the pyrazolone magenta dye-forming coupler during a bleach step in a color photographic process.

24. A color photographic material as defined by claim 1, wherein the coupler composition comprises the pyrazolone magenta dye-forming coupler and the carbonamide compound in a weight ratio of from about 1:0.1 to about 1:10.

25. A color photographic material as defined by claim 1, wherein the aniline or amine compound is included in the coupler composition in an amount sufficient to reduce continued coupling of the pyrazolone magenta dye-forming coupler during a bleach step in a color photographic process.

26. A color photographic material as defined by claim 1, wherein the coupler composition comprises the pyrazolone magenta dye-forming coupler and the aniline or amine compound in a weight ratio of from about 1:0.03 to about 1:3.

27. A method of forming a color photographic image, comprising (A) imagewise exposing a photographic layer, and (B) developing the exposed image, wherein the photographic layer comprises (a) a two-equivalent pyrazolone magenta dye-forming coupler, (b) a carbonamide compound, and (c) at least one compound selected from the group consisting of anilines and amines.

28. A color photographic material, comprising a support bearing a silver halide emulsion and a coupler composition comprising (a) a two-equivalent pyrazolone magenta dye-forming coupler, (b) a carbonamide compound of the formula $$R_6\overset{\overset{\displaystyle O}{\|}}{C}NR_7R_8 \qquad (V)$$

wherein $R_6$, $R_7$ and $R_8$ are individually selected from the group consisting of (i) straight chain, branched and cyclic alkyl groups, straight chain and branched alkenyl groups and straight chain and branched alkylene groups, (ii) said alkyl groups, alkenyl groups and alkylene groups containing one or more substituents selected from the group consisting of alkoxy, aryloxy, aryl, alkoxycarbonyl, aryloxycarbonyl, and acyloxy groups and halogens; (iii) a phenyl group; and (iv) a phenyl group containing one or more substituents selected from the group consisting of alkyl, alkoxy, aryloxy, alkoxycarbonyl, aryloxycarbonyl and acyloxy groups and halogens; and further wherein $R_6$, $R_7$ and $R_8$ combined contain at least 12 carbon atoms, and (c) at least one compound selected form the group consisting of an aniline compound and an amine compound.

29. A method of forming a color photographic image, comprising (A) imagewise exposing a photographic layer, and (B) developing the exposed image, wherein the photographic layer comprises (a) a two-equivalent pyrazolone magenta dye-forming coupler, (b) a carbonamide compound of the formula $$R_6\overset{\overset{\displaystyle O}{\|}}{C}NR_7R_8 \qquad (V)$$

wherein $R_6$, $R_7$ and $R_8$ are individually selected from the group consisting of (i) straight chain, branched and cyclic alkyl groups, straight chain and branched alkenyl groups and straight chain and branched alkylene groups, (ii) said alkyl groups, alkenyl groups and alkylene groups containing one or more substituents selected from the group consisting of alkoxy, aryloxy, aryl, alkoxycarbonyl, aryloxycarbonyl, and acyloxy groups and halogens; (iii) a phenyl group; and (iv) a phenyl group containing one or more substituents selected from the group consisting of alkyl, alkoxy, aryloxy, alkoxycarbonyl, aryloxycarbonyl and acyloxy groups and halogens; and further wherein $R_6$, $R_7$ and $R_8$ combined contain at least 12 carbon atoms, and (c) at least one compound selected from the group consisting of anilines and amines.

* * * * *

UNITED STATES PATENT AND TRADEMARK OFFICE

CERTIFICATE OF CORRECTION

PATENT NO. : 5,200,309

DATED : April 6, 1993

INVENTOR(S) : MERKEL et al

It is certified that error appears in the above-identified patent and that said Letters Patent is hereby corrected as shown below:

Column 28, line 6, please change "a rylsulfonyl" to --arylsulfonyl--.

Signed and Sealed this

Fourth Day of January, 1994

*Attest:*

*Attesting Officer*

Bruce Lehman

BRUCE LEHMAN

*Commissioner of Patents and Trademarks*